US005271258A

United States Patent [19]

Bernier et al.

[11] Patent Number: 5,271,258

[45] Date of Patent: Dec. 21, 1993

[54] METHOD AND APPARATUS OF FORMING ONE-PIECE CORE CAP STAMPING WITH KEYWAY

[75] Inventors: Real Bernier, Charlesbourg; Rosaire Michel, Beauport, both of Canada

[73] Assignee: SLM Canada Inc., Beauport, Canada

[21] Appl. No.: 856,764

[22] Filed: Mar. 23, 1992

Related U.S. Application Data

[63] Continuation of Ser. No. 713,866, Jun. 12, 1991, abandoned.

[51] Int. Cl.[5] ..... B21D 22/24; B21D 22/26

[52] U.S. Cl. ..... 72/348; 72/349; 72/708; 413/8; 413/12; 220/356

[58] Field of Search ..... 72/347, 348, 349, 355.4, 72/356, 708; 413/8, 12; 220/352, 353, 356, 293

[56] References Cited

U.S. PATENT DOCUMENTS

| | | | |
|---|---|---|---|
| 344,459 | 6/1886 | Paull et al. | 72/349 |
| 757,167 | 4/1904 | Woods | 220/356 |
| 1,358,531 | 11/1920 | Dodge . | |
| 1,648,399 | 11/1927 | Hill . | |
| 1,651,705 | 12/1927 | Hill . | |
| 1,802,694 | 4/1931 | Bebie . | |
| 1,947,032 | 2/1934 | Bebie . | |
| 2,266,494 | 12/1941 | Adams . | |
| 2,269,313 | 1/1942 | Klocke | 72/349 |
| 3,204,680 | 9/1965 | Barry | 72/349 |
| 3,611,552 | 10/1971 | Cushing et al. | 72/348 |
| 4,395,811 | 8/1983 | Frye | 29/507 |
| 4,407,428 | 10/1983 | Stone | 220/356 |
| 4,418,471 | 12/1983 | Torii et al. | 29/596 |
| 4,978,024 | 12/1990 | Newman et al. | 220/90.4 |

FOREIGN PATENT DOCUMENTS

| | | | |
|---|---|---|---|
| 45223 | 4/1981 | Japan | 413/8 |
| 63541 | 3/1988 | Japan | 413/12 |
| 277856 | 12/1951 | Switzerland | 220/356 |

*Primary Examiner*—David Jones

*Attorney, Agent, or Firm*—Samuel Meerkreebs

[57] ABSTRACT

A core cap is formed from a one-piece sheet metal blank in which an inner cylindrical sleeve is formed and a reverse-fold outer sleeve determining a bight therebetween, and a recess is gradually formed by stamping in the bight and the inner sleeve so as to provide a keyway with parallel side walls symmetrically parallel with the axis of the inner sleeve.

4 Claims, 3 Drawing Sheets

METHOD AND APPARATUS OF FORMING ONE-PIECE CORE CAP STAMPING WITH KEYWAY

This is a continuation, of application Ser. No. 07/713,866 filed Jun. 12, 1991, now abandoned.

BACKGROUND OF THE INVENTION

1. Field of the Invention

The present invention relates to core caps, and more particularly, to a method of making a core cap with an integral keyway.

2. Description of the Prior Art

Core caps typically require a strong rigid inner sleeve for inserting into the end of a tubular core. The core may be a lightweight fiberboard or plastic cylindrical tube for a large paper roll or the like. It is important that the cap have a keyway formed in the rigid sleeve in order to receive and transmit torque to the otherwise easily deformed core. The cap must also be shaped about the end of the core in order to present a wear and impact-resistant end to the core. Such core caps have been made either as a one-piece stamping or, when a keyway is required, in two pieces. That is, a keyway insert is welded to the stamping.

SUMMARY OF THE INVENTION

It is an aim of the present invention to provide an improved core cap, and in particular, a one-piece stamped metal core cap with a keyway formed therein.

A construction in accordance with the present invention comprises a one-piece stamped metal core cap having an inner sleeve of circular cylindrical cross-section and a reverse-fold outer sleeve of circular cylindrical cross-section concentric with the inner sleeve with a bight formed therebetween, and a keyway defined partly in the inner sleeve and in the bight portion, the keyway having planar parallel side walls symmetrically parallel to the axis of the inner sleeve.

An important aspect of the present invention is the method of forming the core cap. It is clear that a keyway of the type required, that is, where the walls are planar and parallel and the corners are at right angles, is not easily formed by stamping. Given the reverse fold formed in the stamping, the stresses in the metal would not allow the walls forming the recess to be readily formed at the intersection of the bight and the inner sleeve.

It is, therefore, an aim of the present invention to provide a method of forming a core cap formed from a one-piece metal stamping having a suitable keyway formed therein.

It is a further aim of the present invention to provide a method of forming a one-piece metal stamping of a core cap with a reverse fold and a keyway recess formed partly in the bight.

A method of forming a core cap in accordance with the present invention comprises the steps of first, selecting a blank of suitable sheet metal, second, forming a shallow U-shaped cup by stamping, third, drawing the cup in a plurality of successive stamping procedures to provide a deeper cup of smaller diametric dimensions having a bottom wall and a cylindrical wall, fourth, reverse stamping the bottom wall in order to form a reverse fold inwardly of the cylindrical wall with the bottom parallel and adjacent a plane containing the rim of the cup, fifth, causing a further step of drawing the bottom wall past the plane containing the rim of the cup such that an inner cylindrical wall is formed having an axial extent thereof which is greater than the axial extent of the outer cylindrical wall, sixth, forming a recess in the inner cylindrical wall at the intersection with the reverse fold in at least two successive stamping steps wherein the depth of the recess is gradually increased, and the recess includes parallel planar side walls symmetrically parallel to the axis of the inner cylinder, and seventh, punching out the bottom wall at any time from the end of the third step of drawing the inner cylindrical wall to the end of the sixth step of forming the recess.

In a more specific embodiment the second to seventh steps are done simultaneously on a succession of individual blanks in different stages of formation, by using a ganged metal stamping means while the blanks advance intermittently on a linear conveyor.

The advantage of the above process is that the core cap can be stamped from a single blank of sheet metal and a keyway in the form of a recess can be formed in the inner wall at the reverse fold in order to avoid the necessity of fabricating a two-piece core cap in order to provide the keyway.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
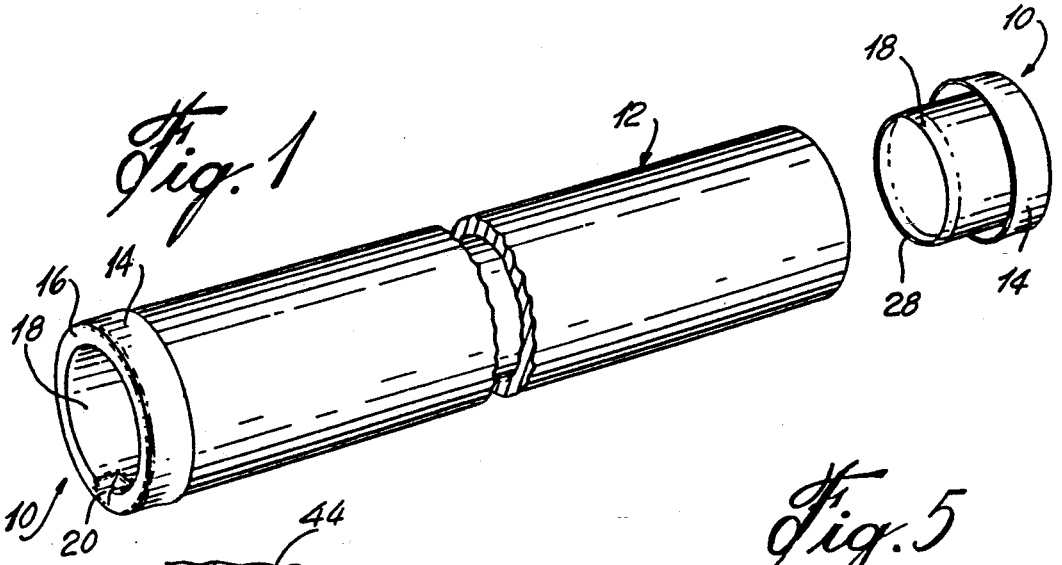
FIG. 1 is a perspective view, partly broken away and partly exploded, showing a typical winding core with core caps in accordance with the present invention.

Referring now to the drawings, FIG. 1 shows a typical core 12 to which a core cap 10 has been mounted on each end thereof.

Figure 3:
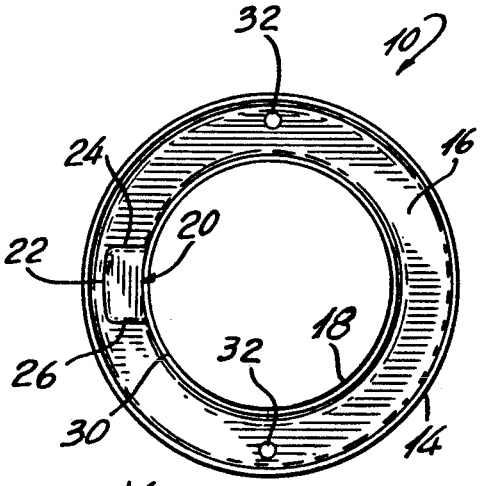
FIG. 3 is a bottom plan view thereof.
Figure 2:
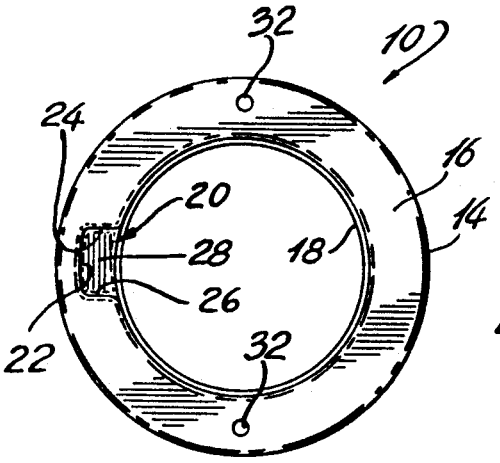
FIG. 2 is a top plan view of a typical core cap in accordance with the present invention.

The core cap includes an outer sleeve 14 of circular cylindrical configuration, an inner sleeve 18 of cylindrical configuration concentric with the outer sleeve 14, and a bight 16 extends between the inner sleeve 18 and the outer sleeve 14 and is integral therewith. As shown in FIGS. 1, 2, and 3, a keyway in the form of a recess 20 is formed in the inner sleeve 18 and the bight 16. The keyway includes side walls 24 and 26 which are in planes parallel to each other and to the axis of the concentric sleeves. The recess is also provided with a rear wall 22 and a bottom wall 28. The bottom of sleeve 18 is formed by a rim 28 which can be slightly tapered in order to allow better insertion on the end of the core 12.

The core cap 10 is formed from a steel sheet stamped into the form shown in FIGS. 2 and 3. The stamping process is illustrated in FIGS. 4*a* to 4*j* in successive steps starting with a blank of sheet metal 8 as shown in FIG. 4*a*.

As will be described the stamping steps shown in FIGS. 4*b* to 4*j* can be done by a ganged stamping apparatus having a separate stamping die for each step acting in unison on successive blanks in different stages of formation over a linear conveyor (not shown). The successive blanks are advanced on the linear conveyor by a shuttle means (not shown), from one stamping position to the other.

Figure 5:
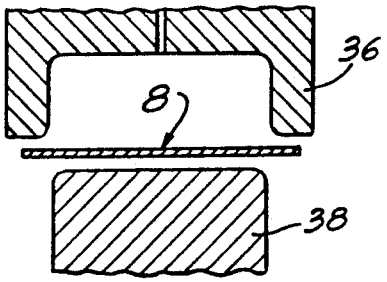
FIG. 5 is a fragmentary enlarged cross-section showing the stamping apparatus for forming the blank of FIG. 4*a* to the shallow cup of FIG. 4*b;*
Figures 4A, 4B, 4C, 4D, 4E, 4F, 4G, 4H, 4I, 4J:
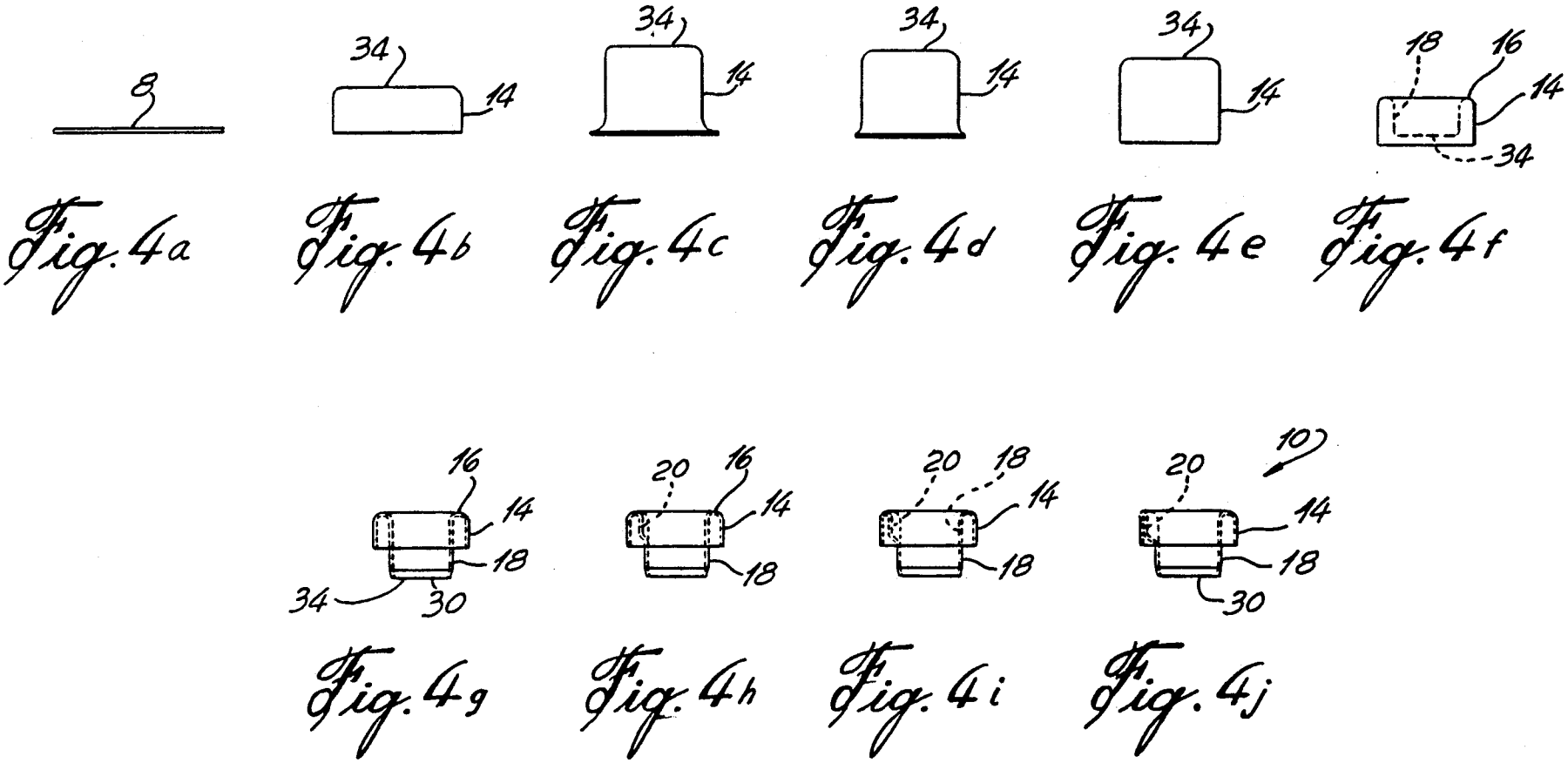
FIGS. 4*a* to 4*j* are schematic step-by-step illustrations of the different forms the sheet metal blank will take in the process of forming it into a finished core cap.

FIGS. 4*b* and 5 illustrate the formation of the blank 8 into a cup-shaped member having the beginning of an outer sleeve 14 and a bottom wall 34. As shown in FIG. 5, the stamping dies could typically include a female die member 36 and a mating male die member 38.

Figure 6:
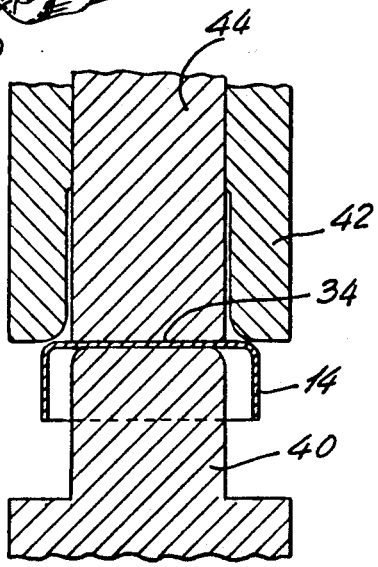
FIG. 6 is a fragmentary cross-section of the succeeding stamping step to draw the deeper cup shown in FIG. 4*c;*

FIGS. 4*c* and 6 illustrate the succeeding step of forming the core cap by drawing out the bottom wall and thus extending the outer sleeve 14. As shown in FIG. 6, this is accomplished by using a male die member 40, a guide member 44, and a hollow cylindrical female die member 42 which slides on guide member 44 and draws the material of the walls 14 and 34 to reduce the diameter of the cup and to draw out the 30 outer wall or sleeve 14.

FIGS. 4*d* and 4*e* show successive steps using die members similar to that shown in FIG. 6 to further draw the outer sleeve 14.

Figure 7:
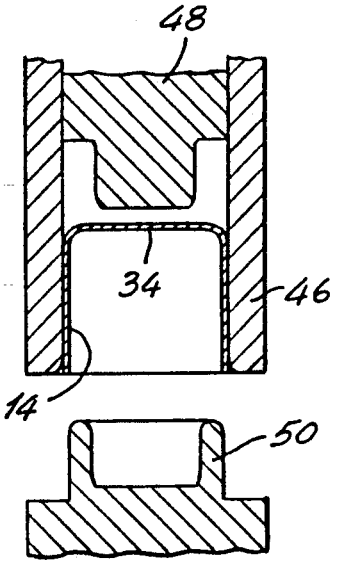
FIG. 7 is a fragmentary cross-section similar to FIGS. 5 and 6 showing a further stamping apparatus for providing the shape of the element shown in FIG. 4*f;*

FIGS. 4*f* and 7 illustrate the next step of reverse folding the inner sleeve 18 by using a cylinder 46 to retain the outer sleeve 14. A male die member 48 slides within the cylinder 46 and engages the bottom wall 34 to draw it into the female die member 50. The result of this step is that the bottom wall 34 is still within the confines of the outer sleeve 14 and is slightly spaced from the bottom rim of the outer sleeve 14. An inner sleeve 18 is now formed and a reverse fold or bight 16 as well.

Figure 8:
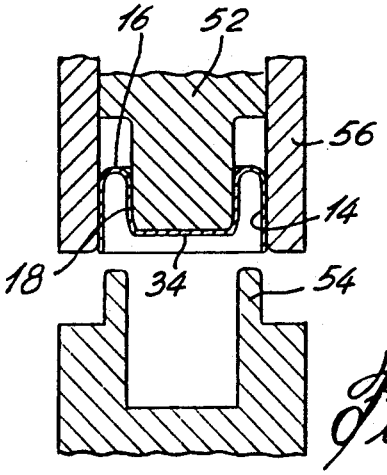
FIG. 8 is a fragmentary cross-section of the stamping tools for drawing the element of FIG. 4*f* into the shape shown in FIG. 4*g;*
Figure 9:
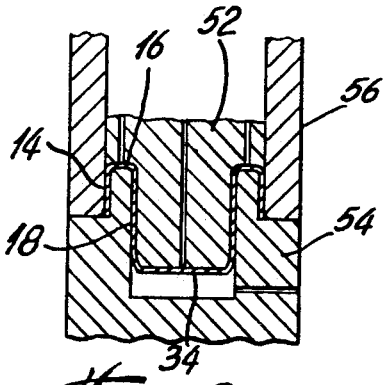
FIG. 9 is a fragmentary cross-section of the dies required to advance the core cap in accordance with FIG. 4*g*.

The next step, as illustrated in FIGS. 4*g*, 8, and 9, requires a further drawing of the inner sleeve 18, and this is accomplished by the male die 52 sliding within cylinder 56 and engaging the bottom wall 34 to draw it further into a female die 54.

Figure 10:
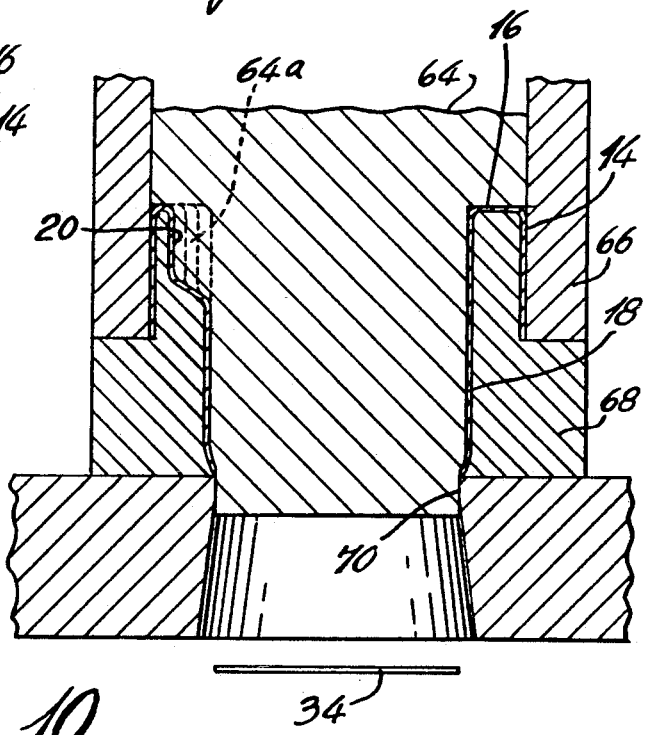
FIG. 10 is an enlarged fragmentary cross-section of the stamping tools for forming the recess in the core cap according to FIGS. 4*h* through 4*j*.

The steps shown in FIGS. 4*h* to 4*j* provide for a successive forming of the recess 20 to form the keyway as well as the punching out of the bottom wall 34. FIG. 10 shows the die cylinder 66 retaining the outer sleeve 14 and a male die member 64 which is suitable to punch out the bottom wall 34 through an opening 70 in the female die 68. Successive male dies 64 would have larger projections 64*a* to accomplish the successive forming of the recess 20. The progressive forming of the recess 20 by means of the male die 64 reduces the stresses on the wall material allowing the recess 20 to be fully formed with relatively right angular corners and parallel side walls 24 and 26. The recess 20 serves as the keyway in the finished core cap 10.

It is contemplated that different outer diameter core caps can be provided. Depending on the thickness of the wall of the core, at least two sizes of core caps may be required. By keeping the internal diameter of the inner sleeve 18 of the core cap 10 constant, the outer sleeve 14 can vary in diameter. The recess 20 formed in the bight portion 16 and the inner sleeve 18 will be of constant dimension regardless of the diameter of the outer sleeve 14.

In an example of a particular core cap 10, the inner sleeve 18 had a diameter of 3.034 inches and the outer diameter of the outer sleeve 14, 4.0 inches. The recess 20 had a width tangential to the inner sleeve 18 of 0.78 inches and a depth of 0.796 inches. The overall axial length of the inner sleeve 18 was 3 inches, and the axial length of the outer sleeve 14 was 1.5 inches.

In another example of a core cap 10, the dimensions of the inner sleeve 18 and the recess 20 remained the same, but the diameter of the outer sleeve 14 was 4.375 inches and its axial length remained at 1.5 inches.

We claim:

1. A method of forming a core cap comprises the steps of selecting a blank of suitable sheet metal, forming a shallow U-shaped cup by stamping, drawing the cup in at least three successive stamping procedures to provide a deeper cup of smaller diametric dimensions having a bottom wall and a cylindrical wall, reverse stamping the bottom wall in order to form a reverse fold inwardly of the cylindrical wall with the bottom parallel and adjacent a plane containing the rim of the cup, causing a further step of drawing the bottom wall past the plane containing the rim of the cup such that an inner cylindrical wall is formed having an axial extent thereof which is greater than the axial extent of the outer cylindrical wall and forming a recess with a rear wall and side walls only in the inner cylindrical wall at the intersection with the reverse fold in at least three successive stamping steps such that the depth of the recess is gradually increased and the rear wall and side walls of the recess are formed with relative right angles with the minimum amount of internal stress in the wall material and the side walls are planar and symmetrically parallel to the axis of the inner cylinder, whereby the one-piece core cap has maximum strength characteristics and minimum internal wall stresses.

2. A method as defined in claim 1, wherein the bottom wall is punched out at any one of the steps from the last step of drawing the inner cylindrical wall to the final step of forming the recess.

3. A method as defined in claim 1, the core cap transformed from a blank to the final core cap having an integral recess in the cylindrical wall at the intersection with a reverse fold, wherein the forming steps are effected by a ganged stamping means which intermittently advances the blanks.

4. A method as defined in claim 1, wherein a further step is provided, wherein the free end of the cylindrical wall is formed with a taper converging inwardly thereof.

* * * * *